United States Patent [19]

Shepherd

[11] Patent Number: 4,890,432

[45] Date of Patent: Jan. 2, 1990

[54] ROOF TILE

[75] Inventor: Michael C. Shepherd, Colchester, United Kingdom

[73] Assignee: Hopedelta Limited, Peterborough, England

[21] Appl. No.: 170,735

[22] Filed: Mar. 21, 1988

[30] Foreign Application Priority Data

Mar. 25, 1987 [GB] United Kingdom ..... 8707160

[51] Int. Cl.[4] ..... E04F 3/24

[52] U.S. Cl. ..... 52/314; 52/555; 52/535; 52/539; 52/542

[58] Field of Search ..... 52/314, 535, 539, 555, 52/554, 542

[56] References Cited

U.S. PATENT DOCUMENTS

| | | | |
|---|---|---|---|
| 1,572,919 | 2/1926 | Geese | 52/314 |
| 1,853,822 | 4/1932 | Krauss | 52/314 |
| 4,251,967 | 2/1981 | Hoofe | 52/535 |
| 4,731,969 | 3/1988 | Baker et al. | 52/539 X |

FOREIGN PATENT DOCUMENTS

| | | | |
|---|---|---|---|
| 10722 | 12/1932 | Australia | 52/535 |
| 17596 | 1/1913 | France | 52/314 |
| 1369567 | of 1964 | France | 52/539 |
| 2277954 | 2/1976 | France | 52/555 |
| 2396845 | 3/1979 | France | 52/555 |
| 2592082 | 6/1987 | France . | |

*Primary Examiner*—Carl D. Friedman
*Assistant Examiner*—Jerrold D. Johnson
*Attorney, Agent, or Firm*—Bernard, Rothwell & Brown

[57] ABSTRACT

An interlocking roof tile is formed as a single integral member having at least two tile elements lying in different planes so that a step is formed between them, the tile elements being offset from each other both along a row direction and transverse to a row direction so that one tile element will lie in a row above and laterally offset from the other.

6 Claims, 5 Drawing Sheets

ROOF TILE

The present invention relates to roof tiles.

BACKGROUND OF THE INVENTION

Known roof tiles for houses and other buildings include double lap plain tiles in which relatively small rectangular plain tiles are fixed side by side in horizontal rows with two thicknesses of tile all over the roof and three thicknesses at the frequent laps. It is also known to use more economical single lap tile arrangements in which most of the roof area is covered by a single thickness of tile with two thicknesses at the laps. The use of plain tiles in a double lap arrangement is often uneconomical for mass housing.

It is an object of the present invention to provide roof tiles which may be used in a single lap arrangement while simulating the finished appearance of a plain tile roof.

SUMMARY OF THE INVENTION

The present invention provides an interlocking roof tile for use in constructing a roof formed of a plurality of tile elements side by side in horizontal rows wherein (a) the tile elements of one row have junctions between adjacent elements which are offset laterally relative to junctions between tile elements in an adjacent row and (b) tile elements in adjacent rows lie in different planes so that steps are formed between tile elements in adjacent rows, said roof tile comprising as a unitary member at least two tile elements forming a laterally extending step between them and offset from each other both along a row direction and transverse to a row direction so that one tile element will lie in a row above and laterally offset from the other.

Preferably four tile elements are provided as a single unitary roof tile member, two tile elements lying in one row laterally offset from two tile elements lying in an adjacent row.

In an alternative construction six tile elements are provided as a unitary roof tile member, three tile elements lying side by side in one row laterally offset from three tile elements in an adjacent row.

In one construction, each tile element is formed as a rectangular member.

In an alternative construction each tile element has a curved lower edge.

Preferably each roof tile has interlocking means along the lateral edge of one or more tile elements arranged to engage interlocking means on a lateral edge of an adjacent tile.

Preferably the upper edge of each tile is provided on an underface of the tile with means for engaging a batten or laterally extending roof member.

DESCRIPTION OF THE PREFERRED EMBODIMENT

The tiles of these examples are formed as interlocking single lap tiles which may be cast in concrete, clay or other suitable material.

Figure 2:
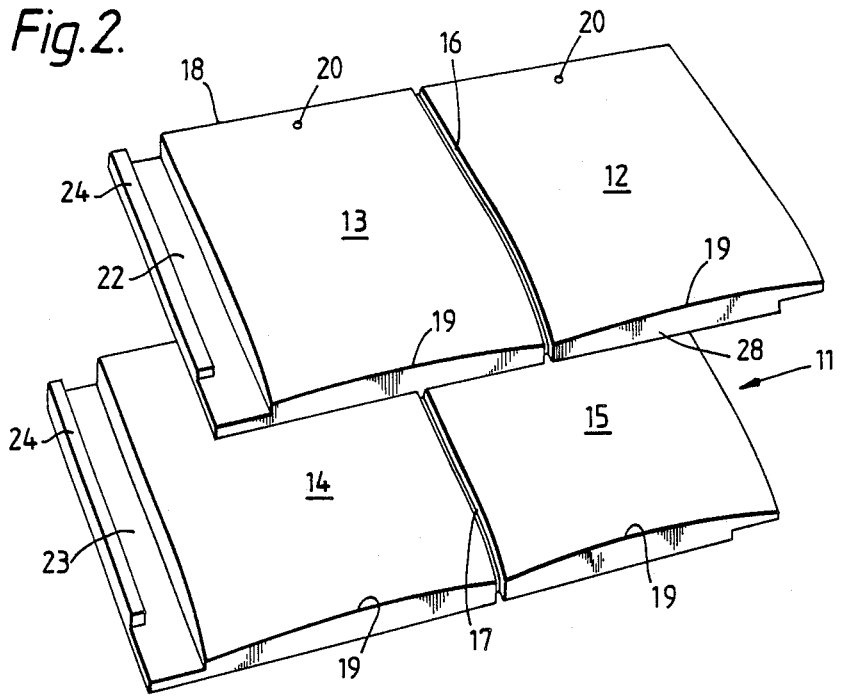
FIG. 2 is a top perspective view of one tile incorporating four tile elements.
Figure 3:
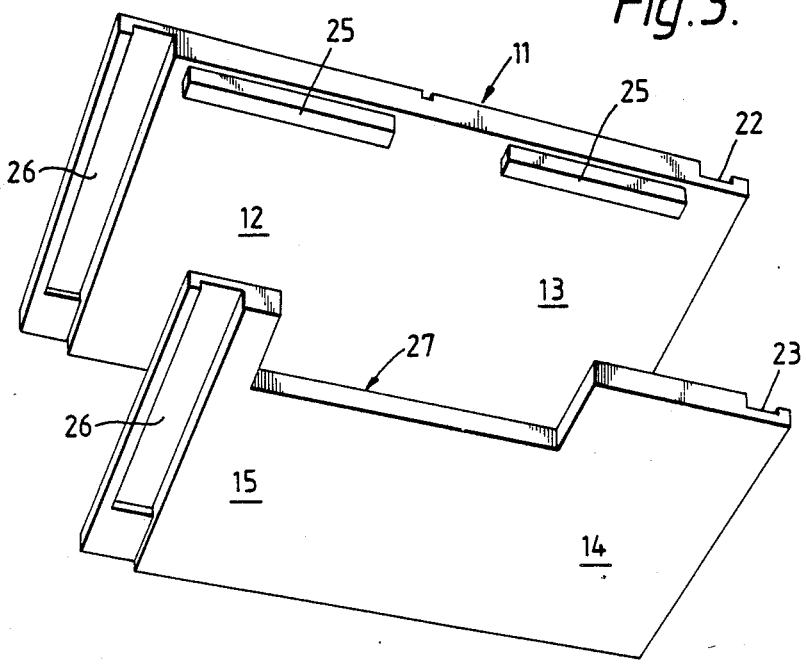
FIG. 3 is an underneath view of the tile of FIG. 2.
Figure 4:
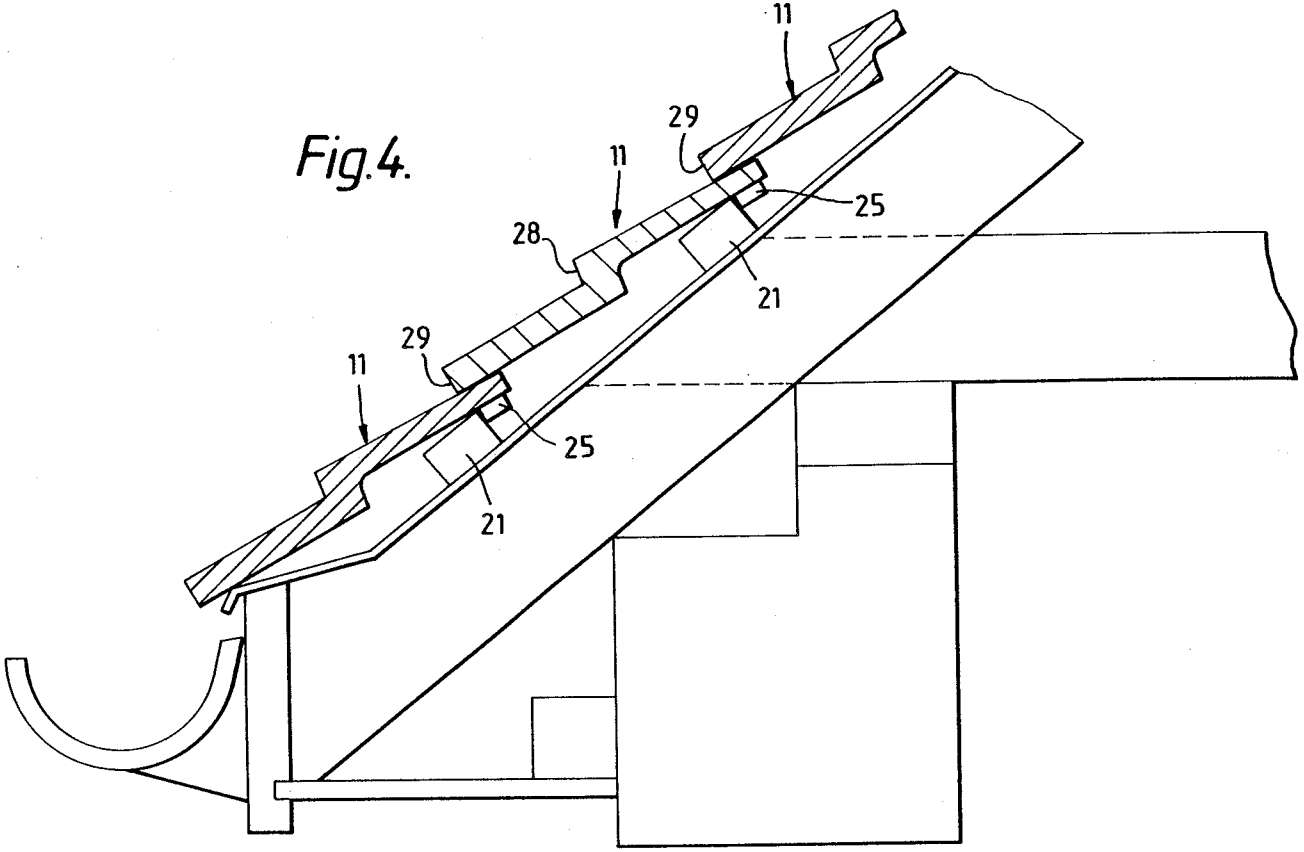
FIG. 4 is a side view of the mounting of the tile elements of FIG. 2 on a roof.

In the embodiment shown in FIGS. 2 and 3, each tile 11 comprises four tile elements 12, 13, 14 and 15 formed as a single unitary cast member. Each tile element is of similar rectangular shape with the two tile elements 12 and 13 lying side by side in one row position separated by a junction 16. The tile elements 14 and 15 lie side by side in an adjacent lower row separated by a similar junction 17 which is offset laterally relative to the junction 16. The upper edges 18 of each tile have a straight edge whereas the upper surface of the lower edge 19 of each tile is curved as shown. Fixing holes 20 are provided in each of the upper tile elements 12 and 13 to allow securing of the tiles to wooden battens 21 as shown in FIG. 4. The lateral edges of the tiles 13 and 14 are formed with rectangular channels 22 and 23 respectively to permit interlocking with laterally adjacent tiles. Each of the channels 22 and 23 is formed with a lateral edge member 24 which extends from the upper edge of the tile element to a position spaced from the lower edge of the tile element. As can be seen from FIG. 3, the underface of each tile 11 is formed with downward projections 25 on each of the tile elements 12 and 13 and these projections 25 may hook over battens 21 as shown in FIG. 4 in order to secure the tiles on a pitch roof of a house. At the lateral edges of the tile elements 12 and 15 recesses 26 are provided for receiving the edge members 24 of an adjacent tile. The upper part of tile elements 14 and 15 is cut away as shown at 27 in order to reduce the weight of each tile.

Figure 1:
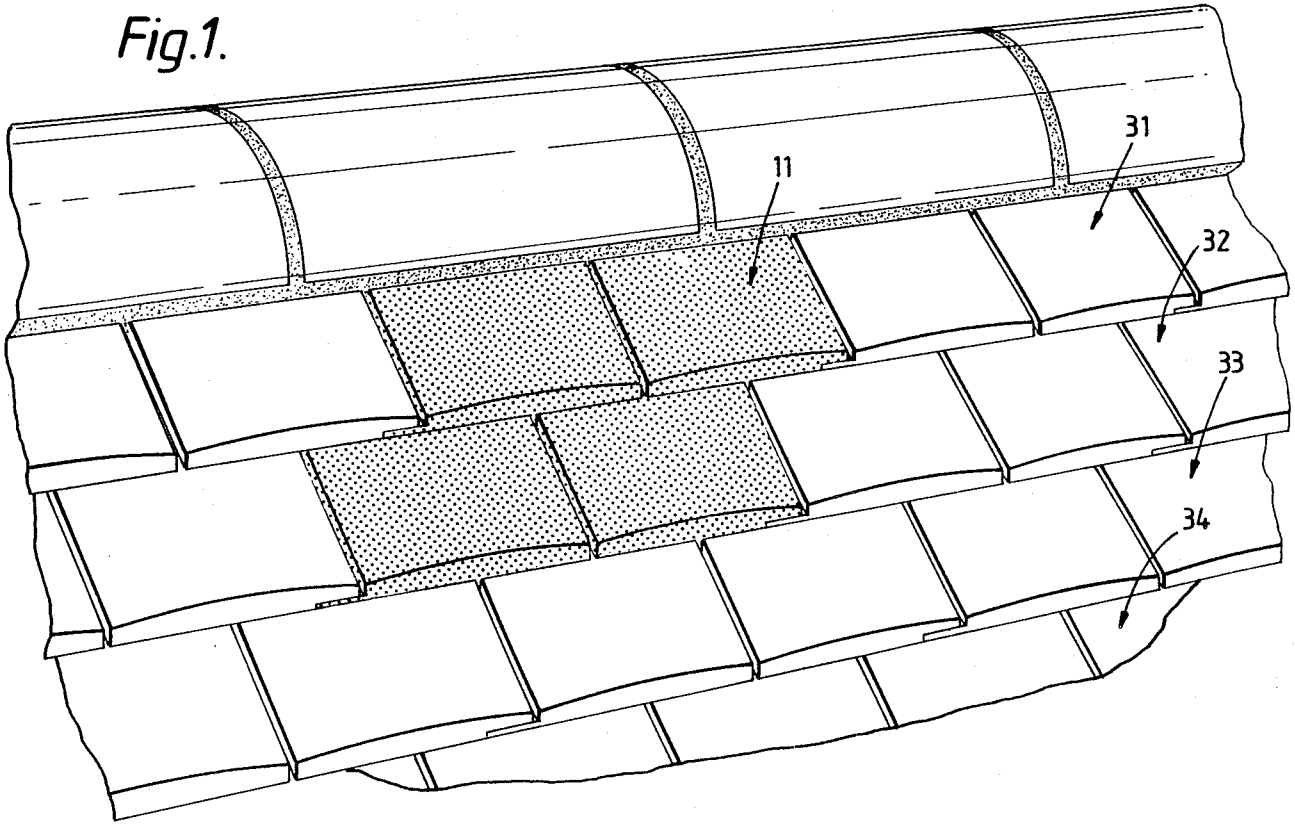
FIG. 1 shows part of a pitch roof of a house having rows of rectangular tile elements in which groups of four elements are formed as single unitary tile members.

As can be seen from FIG. 2, the upper tile elements 12 and 13 lie in a different plane from the lower tile elements 14 and 15, although they are all integrally formed as a single unit, so that a vertical step 28 is formed between the rows of tile elements provided by a single tile. This matches the step 29 which is formed by overlapping adjacent tiles as indicated in FIG. 4. As is illustrated in Figure 4, each tile is placed in a single lap arrangement so that a double tile thickness is formed only in the short region of overlap where the steps 29 occur. These steps 29 extend horizontally and are symmetrical with the horizontally extending steps 28 formed by the upper and lower tile elements on each tile. In this way the finished roof construction has the appearance shown in FIG. 1 wherein a single tile element has been marked by heavy cross-hatching. This produces horizontal rows 31, 32, 33 and 34 each consisting of a plurality of small rectangular tile elements in which the junctions between laterally adjacent tile elements are offset from one row to the next thereby simulating the appearance of a roof formed by small plain tiles which would normally be laid in a double overlap construction in order to be sufficiently weatherproof.

Although in the above example each tile has four tile elements, other arrangements are possible. For example, each unitary tile may be formed with two tile elements, four tile elements, six tile elements or any other desired number provided each tile has elements offset along a row and transverse to a row so that the laying of each tile places some elements in different rows and laterally offset relative to each other.

Figure 5:
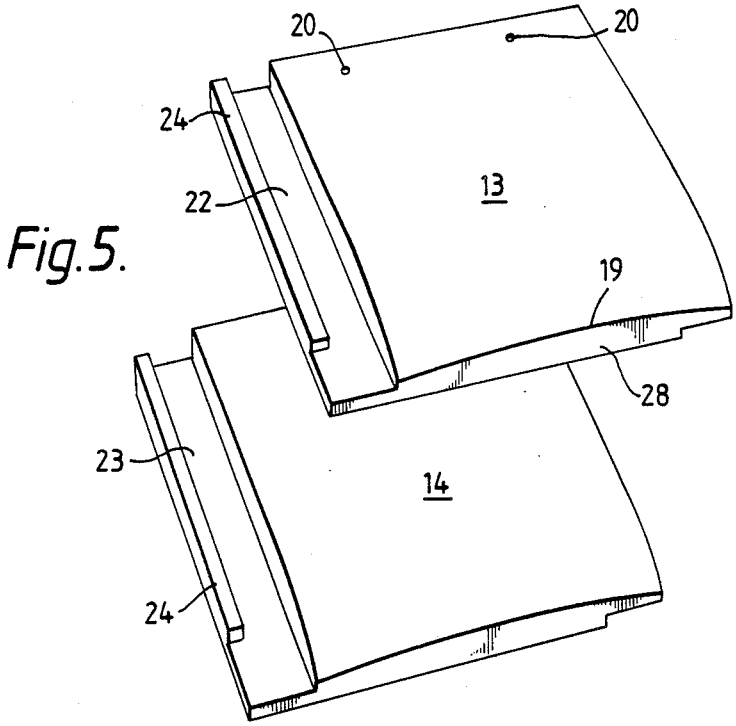
FIG. 5 illustrates an alternative construction similar to FIG. 2 in which only two tile elements are formed as a single unitary tile member.
Figure 6:
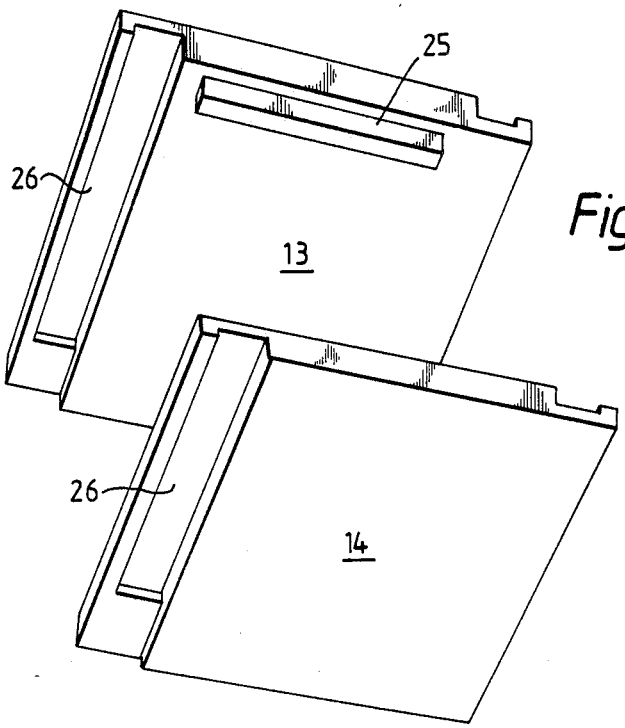
FIG. 6 is an underneath view of the tile of FIG. 5.

FIGS. 5 and 6 show a two tile element construction of tile which is generally similar to that of FIGS. 2 and 3 and similar reference numerals have been used.

Figure 7:
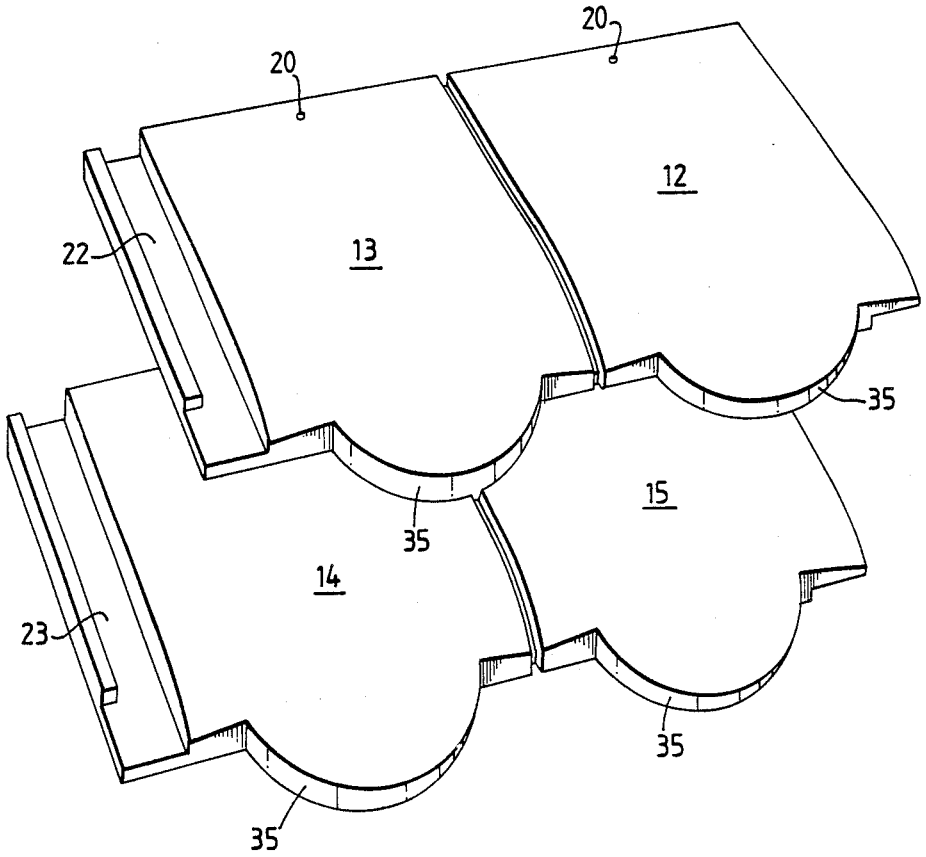
FIG. 7 is a view similar to FIG. 2 showing an alternative tile element construction in which the lower edge of each tile element is curved.

The shape of each tile element may be varied. For example each tile element may have a club-tail shape or a beaver-tail shape or even a fish-tail shape. FIG. 7 shows a four element tile similar to FIG. 2 in which the lower edges of each tile element are formed with a curved lower edge marked 35.

The invention is not limited to the details of the foregoing examples.

I claim:

1. An interlocking roof tile for use in constructing a roof formed of a plurality of tile elements side-by-side in overlapping horizontal rows, said roof tile comprising:

a plurality of similar whole tile elements located with at least one of said tile elements in a first row and at least one of said tile elements in a second row, each tile element having lateral edges to form a junction with an adjacent tile element in the same row, the tile elements in said first row being offset laterally from tile elements in said second row;

an elongated step formed along the roof tile between said first and second rows such that the tile elements in said first row lie in a different plane from the tile elements in said second row; and a lateral interlock structure at opposite side edges of each roof tile, said lateral interlock structure including first and second interlocks respectively provided on opposite side edges of whole tile elements at opposite ends of said first row, and third and fourth interlocks respectively provided on opposite side edges of whole tile elements at opposite ends of said second row, said first and third interlocks being located on one side of said roof tile laterally offset from each other and said second and fourth interlocks being located the opposite side of said roof tile laterally offset from each other, both side edges of said roof tile thereby being staggered, first and third interlocks of one roof tile interlocking with second and fourth interlocks of an adjacent roof tile.

2. An interlocking roof tile as claimed in claim 1 wherein a single unitary roof tile member comprises four tile elements, two tile elements lying in one row laterally offset from two tile elements lying in an adjacent row.

3. An interlocking roof tile as claimed in claim 1 wherein each tile element is formed as a rectangular member.

4. An interlocking roof tile as claimed in claim 1 wherein each tile element has a curved lower edge.

5. An interlocking roof tile as claimed in claim 1 wherein each roof tile has interlocking means along the lateral edge of one or more tile elements arranged to engage interlocking means on a lateral edge of an adjacent tile.

6. An interlocking roof tile as claimed in claim 1 wherein said tile is provided on an underface of the upper edge with means for engaging a laterally extending roof member.

* * * * *